US008403027B2

(12) United States Patent
Tomes, Jr. et al.

(10) Patent No.: US 8,403,027 B2
(45) Date of Patent: Mar. 26, 2013

(54) STRIP CASTING OF IMMISCIBLE METALS

(75) Inventors: David A. Tomes, Jr., Sparks, NV (US); Gavin F. Wyatt-Mair, Lafayette, CA (US); David W. Timmons, Reno, NV (US); Ali Unal, Export, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 11/734,113

(22) Filed: Apr. 11, 2007

(65) Prior Publication Data

US 2008/0251230 A1 Oct. 16, 2008

(51) Int. Cl.
*B22D 7/10* (2006.01)

(52) U.S. Cl. ..... 164/122; 164/462; 164/480

(58) Field of Classification Search ..... 164/122, 164/462, 480

See application file for complete search history.

(56) References Cited

U.S. PATENT DOCUMENTS

| | | | |
|---|---|---|---|
| 2,693,012 | A | 11/1854 | Harris et al. |
| 3,078,563 | A | 2/1963 | Gould et al. |
| 3,167,830 | A | 2/1965 | Hazellet et al. |
| 3,232,796 | A | 2/1965 | Anderson et al. |
| 3,346,370 | A | 10/1967 | Jagaciak et al. |
| 3,346,371 | A | 10/1967 | Jagaciak et al. |
| 3,346,372 | A | 10/1967 | Jagaciak et al. |
| 3,346,373 | A | 10/1967 | Jagaciak et al. |
| 3,346,374 | A | 10/1967 | Jagaciak et al. |
| 3,346,375 | A | 10/1967 | Jagaciak et al. |
| 3,346,376 | A | 10/1967 | Jagaciak et al. |
| 3,346,377 | A | 10/1967 | Jagaciak et al. |
| 3,366,476 | A | 1/1968 | Jagaciak et al. |
| 3,490,955 | A | 1/1970 | Winter et al. |
| 3,556,872 | A | 1/1971 | Jagaciak et al. |
| 3,582,406 | A | 6/1971 | Ford et al. |
| 3,617,395 | A | 11/1971 | Ford |
| 3,708,352 | A | 1/1973 | Brown et al. |
| 3,761,322 | A | 9/1973 | Winter et al. |
| 3,831,323 | A | 8/1974 | Widner et al. |
| 4,002,197 | A | 1/1977 | Hazelett et al. |

(Continued)

FOREIGN PATENT DOCUMENTS

| | | |
|---|---|---|
| AU | 2005214348 | 9/2011 |
| CA | 2557417 | 3/2010 |

(Continued)

OTHER PUBLICATIONS

E. C. Ellwood, "Tin in Bearing Alloys," Tin and Its Alloys, pp. 282-295, Edward Arnold (Publishers) Ltd, London.

(Continued)

*Primary Examiner* — Nicholas P D'Aniello
(74) *Attorney, Agent, or Firm* — Greenberg Traurig, LLP

(57) ABSTRACT

The present invention discloses a method of strip casting an aluminum alloy from immiscible liquids that yields a highly uniform structure of fine second phase particles. The results of the present invention are achieved by using a known casting process to cast the alloy into a thin strip at high speeds. In the method of the present invention, the casting speed is preferably in the region of about 50-300 feet per minute (fpm) and the thickness of the strip preferably smaller than 0.08-0.25 inches. Under these conditions, favorable results are achieved when droplets of the immiscible liquid phase nucleate in the liquid ahead of the solidification front established in the casting process. The droplets of the immiscible phase are engulfed by the rapidly moving freeze front into the space between the Secondary Dendrite Arms (SDA).

9 Claims, 4 Drawing Sheets

U.S. PATENT DOCUMENTS 4,098,957 A 7/1978 Vernam et al.
4,146,163 A 3/1979 Anderson et al.
4,146,164 A 3/1979 Anderson et al.
4,151,013 A 4/1979 Thompson et al.
4,161,553 A 7/1979 Vernam et al.
4,235,646 A 11/1980 Neufeld et al.
4,238,248 A 12/1980 Gyongyos et al.
4,260,419 A 4/1981 Robertson
4,282,044 A 8/1981 Robertson et al.
4,341,261 A 7/1982 Thomson et al.
4,356,618 A 11/1982 Jordan
4,484,614 A 11/1984 Maringer
4,626,294 A 12/1986 Sanders, Jr.
4,751,958 A 6/1988 Flowers et al.
4,782,994 A 11/1988 Raybould et al.
4,823,860 A 4/1989 Lauener
4,828,008 A 5/1989 White et al.
4,828,012 A 5/1989 Honeycutt, III et al.
4,915,158 A 4/1990 Allyn et al.
4,996,025 A * 2/1991 Pratt et al. ..... 420/554
5,015,766 A 5/1991 Kambara et al.
5,047,369 A 9/1991 Fleming et al.
5,053,286 A 10/1991 Pratt et al.
5,106,429 A 4/1992 McAuliffe et al.
5,125,452 A 6/1992 Yamauchi et al.
5,181,969 A 1/1993 Komatsubara et al.
5,333,672 A 8/1994 Gelfgat et al.
5,356,495 A 10/1994 Wyatt-Mair et al.
5,362,523 A 11/1994 Gorynin et al.
5,365,664 A 11/1994 Whitney, Jr.
5,370,171 A 12/1994 Fields et al.
5,400,851 A * 3/1995 Prinz et al. ..... 164/462
5,423,925 A 6/1995 Shoji et al.
5,470,405 A 11/1995 Wyatt-Mair et al.
5,482,107 A 1/1996 Judd
5,496,423 A 3/1996 Wyatt-Mair et al.
5,514,228 A 5/1996 Wyatt-Mair et al.
5,515,908 A 5/1996 Harrington
5,518,064 A 5/1996 Romanowski et al.
5,536,587 A 7/1996 Whitney, Jr.
5,564,491 A 10/1996 Harrington
5,585,067 A * 12/1996 Leroy et al. ..... 420/554
5,588,478 A 12/1996 Jin et al.
5,655,593 A 8/1997 Wyatt-Mair et al.
5,728,241 A 3/1998 Gupta et al.
5,742,993 A 4/1998 Sun
5,769,972 A 6/1998 Sun et al.
5,772,799 A 6/1998 Sun et al.
5,772,802 A 6/1998 Sun et al.
5,785,777 A 7/1998 Cantrell et al.
5,833,775 A 11/1998 Newton et al.
5,862,582 A 1/1999 Sun
5,894,879 A 4/1999 Wyatt-Mair et al.
5,934,359 A 8/1999 Strezov
5,942,057 A 8/1999 Hanamura et al.
5,979,538 A 11/1999 Braun et al.
5,983,980 A 11/1999 Freeman et al.
6,044,896 A 4/2000 Harrington
RE36,692 E 5/2000 Gupta et al.
6,056,835 A 5/2000 Miyake et al.
6,063,215 A 5/2000 Harrington
6,082,659 A 7/2000 Sankaran et al.
6,102,102 A 8/2000 Harrington
6,110,604 A 8/2000 Rickerby
6,120,621 A 9/2000 Jin et al.
6,135,199 A 10/2000 Wyatt-Mair
6,146,477 A 11/2000 Clark et al.
6,193,818 B1 2/2001 Legresy et al.
6,221,515 B1 4/2001 Ramos Junior et al.
6,238,497 B1 5/2001 Jin et al.
6,248,193 B1 6/2001 Zhao et al.
6,264,765 B1 7/2001 Bryant et al.
6,264,769 B1 7/2001 Benedetti
6,273,970 B1 8/2001 Kopeliovich et al.
6,280,543 B1 8/2001 Zonker et al.
6,316,061 B1 11/2001 Andler et al.
6,328,823 B1 12/2001 Deicke et al.
6,336,980 B1 1/2002 Benedetti
6,344,096 B1 2/2002 Baumann et al.
6,391,127 B1 5/2002 Wyatt-Mair et al.
6,423,164 B1 7/2002 Bryant et al.
6,537,392 B2 3/2003 Magnusen et al.
6,543,122 B1 4/2003 Perkins et al.
6,581,675 B1 6/2003 Harrington
6,596,671 B2 7/2003 Whitney, Jr. et al.
6,602,363 B2 8/2003 Ren
6,623,797 B2 9/2003 Avalos
6,672,368 B2 1/2004 Unal
6,681,838 B2 1/2004 Cui et al.
6,833,339 B2 12/2004 Whitney, Jr. et al.
6,880,617 B2 4/2005 Wyatt-Mair et al.
6,959,476 B2 11/2005 Li et al.
7,089,993 B2 8/2006 Wyatt-Mair et al.
7,125,612 B2 10/2006 Unal
7,182,825 B2 2/2007 Unal et al.
7,211,161 B2 5/2007 Pillet et
7,503,378 B2 3/2009 Unal
7,846,554 B2 12/2010 Thomes, Jr. et al.
2002/0031658 A1 3/2002 Chow et al.
2002/0153123 A1 10/2002 Unal
2002/0167005 A1 11/2002 Yu et al.
2003/0015309 A1 1/2003 Bouchard et al.
2003/0205357 A1* 11/2003 Unal ..... 164/480
2004/0007295 A1 1/2004 Lorentzen et al.
2004/0035505 A1 2/2004 Unal et al.
2004/0079455 A1 4/2004 Dif et al.
2005/0183801 A1 8/2005 Unal et al.
2005/0211350 A1 9/2005 Unal et al.
2006/0213590 A1 9/2006 Danielou et al.
2007/0000637 A1 1/2007 Wyat-Mair et al.
2007/0095499 A1 5/2007 Tomes, Jr. et al.
2007/0137830 A1 6/2007 Unal
2008/0251230 A1 10/2008 Tomes et al.
2008/0254309 A1 10/2008 Tomes et al.
2010/0084053 A1 4/2010 Tomes et al.
2011/0036464 A1 2/2011 Tomes et al.
2011/0042032 A1 2/2011 Tomes et al.

FOREIGN PATENT DOCUMENTS

CN 1942595 A 4/2007
CN 101039802 A 9/2007
CN 101678440 3/2010
CN 101678444 3/2010
CN 102264930 A 11/2011
EP 0321152 6/1989
EP 0440275 8/1991
EP 0291505 10/1992
EP 0576170 A1 12/1993
EP 0576171 A1 12/1993
EP 0605947 A1 7/1994
EP 0610006 8/1994
EP 0576170 B1 3/2000
EP 0851943 B1 5/2003
EP 2142324 1/2010
EP 1733064 B1 7/2010
EP 2264198 12/2010
EP 2347023 A1 7/2011
JP 50117663 9/1975
JP 51089827 8/1976
JP 6027450 2/1985
JP 61276751 12/1986
JP 626742 1/1987
JP 644458 1/1989
JP 1202344 8/1989
JP 01242762 9/1989
JP 05277656 10/1993
JP 06071303 3/1994
JP 7148557 6/1995
JP 19999511389 8/1999
JP 2000501995 2/2000
JP 11511389 8/2004
JP 2005504635 2/2005
JP 4355342 8/2009
KR 100861563 9/2008
RU 2139953 C1 10/1999
RU 2356998 C2 2/2005
RU 2284364 2/2006

| | | | |
|---|---|---|---|
| RU | 2008121915 | | 12/2009 |
| SU | 1453932 | | 3/1996 |
| WO | 9100933 | | 1/1991 |
| WO | WO-93/22086 | | 11/1993 |
| WO | WO 94/10351 | | 5/1994 |
| WO | WO 94/13472 | | 6/1994 |
| WO | WO 98/45492 | | 9/1996 |
| WO | WO 97/14520 | | 3/1997 |
| WO | WO 97/11205 | | 4/1997 |
| WO | WO 96/27031 | | 10/1998 |
| WO | WO 99/42628 | | 8/1999 |
| WO | WO 02/066181 | A2 | 8/2002 |
| WO | WO 2004/018124 | | 3/2004 |
| WO | WO 2005/080619 | A1 | 9/2005 |
| WO | WO 2006/124045 | A2 | 11/2006 |
| WO | WO 2008/128055 | | 10/2008 |
| WO | WO 2008/128061 | | 10/2008 |
| WO | WO 2010/042604 | A1 | 4/2010 |
| WO | WO 2010/053675 | | 5/2010 |

OTHER PUBLICATIONS

J.Z. Zhao, S. Drees, L Ratke, "Strip Casting of Al-Pb Alloys—a Numerical Analysis," Materials Science and Engineering, vol. A282, pp., circa 2000.
International Search Report and Written Opinion of the International Searching Authority mailed from the European Patent Office on Jul. 4, 2008.
International Search Report and Written Opinion of the International Searching Authority mailed from the European Patent Office on Jul. 4, 2008 for PCT Application No. PCT/US2008/060050.
Supplemental European Search Report for Application No. EP03737080.6 dated Feb. 3, 2006.
European Office Action for Application No. EP03737080.6 dated Jun. 26, 2007.
European Office Action for Application No. EP03737080.6 dated Sep. 25, 2009.
European Office Action for Application No. EP03737080.6 dated Mar. 9, 2010.
European Office Action for Application No. EP03737080.6 dated Mar. 22, 2010.
A. Unal, D.A. Tomes, G.F. Wyatt-Mair and D.W. Timmons. "Alcoa Micromill Caster (AMC): Structure and Properties of AA 5052 Strip Cast at 53 mm Tip Setback."
U.S. Office Action for U.S. Appl. No. 11/734,121 dated Jul. 9, 2009.
U.S. Office Action for U.S. Appl. No. 11/734,121 dated Dec. 23, 2009.
Australian Office Action for Application No. 2008240265 mailed Jun. 15, 2010.
X. Yang, J.D. Hunt and D.V. Edmonds. "A quantitative study of grain structures in twin-roll cast aluminum alloys, part I: AA 1070."
X. Yang, J.D. Hunt and D.V. Edmonds. "A quantitative study of grain structures in twin-roll cast aluminum alloys, part II: AA 3004."
European Patent Office; Office Action Issued Against European Application No. 8799790.4; Feb. 20, 2012; 5 pages; Europe.
State Intellectual Property Office of the People's Republic of China; Notification of the Second Office Action; Issued Against Chinese Application No. 200880018281.6; Feb. 13, 2012; 9 pages; China.
U.S. Patent and Trademark Office; Final Office Action Issued Against U.S. Appl. No. 12/913,972; Mar. 9, 2012; 11 pages; U.S.A.
Japanese Patent Office; Notice of Reasons for Refusal Issued Against Japanese Application No. 2010-503236; Mar. 13, 2012; 8 pages; Japan.
European Patent Office; Office Action Issued Against European Application No. 03737080.6; Mar. 19, 2012; 4 pages; Europe.
Japanese Patent Office; Notice of Reasons for Refusal Issued Against Japanese Application No. 2010-503238; Mar. 27, 2012; 9 pages; Japan.
Hee-Kyung Moon et al., Development of Strip Casting Process at POSCO/RIST; pp. 1-6, Research Institute fo industrial Science & Technology, Republic of Korea.
Randall J. Frick, The Kaiser Can Stock Micromill Process, Kaiser Aluminum and Chemical Corp.; pp. 447-449.
Donald G. Harrington et al., The Keiser Caster-Description and Status, Kaiser Aluminum & Chemical Corp.; pp. 450-457.
P. Griffiths et al., Metal Matrix Composite Sheet Produced by Twin-Roll Casting; Process and Properties of Materials; pp. 207-2212; Department of Materials; University of Oxford, Oxford.
Standard Test Method for Determining the Susceptibility to Intergranular Corrosion of 5XXX Series Aluminum Alloys by Mass Loss After Expposure to nitric Acid (Namlt Test); Designation: G 67-86; pp. 247-248; The American Society for Testing and Materials; USA.
Standard Practice for Evaluating Stress Corrosion Cracking Resistance of Metals and Alloys by Alternate Immersion in 3.5% Sodium Chloride Solution; pp. 162-165; USA.
Philip Thomas; Chapter 2: Continuous Casting of Aluminum Alloys; pp. 26-47.
Von Otto Dahl et al.; Uber Die Aushartung von Aluminum-Magnesium-Legierungen; Zeitschrift Fur Metallkunde; 46 Jajrgang 1955; pp. 94-99.
Taylor Lyman et al.; Heat Treating, Cleaning and Finishing; Metals Handbook; 1964; pp. 277-278; vol. 2, 8th Edition; American Society for Metals; USA.
Mark G. Fontana et al.; Advances in Corrosion Science and Technology; 1972; pp. 210-223; vol. 2, Plenum Press; England.
Ryoichi Nozato et al.; Calorimetric Study of Precipitation Process in Al-Mg Alloys; Transactions of the Japan Institute of Metals; 1980; pp. 580-588; vol. XXI; The Japan Institute of Metals; Japan.
I.Jin et al.; Centre Line Segragation in Twin Roll Cast Aluminum Alloy Slab; Light Metals 1982; Feb. 14, 1982; pp. 873-888; The Metallurgical Society of AIME; USA.
Anne Lise Dons, AlFeSi-Particles in Industrially Cast Aluminum Alloys; Jan. 30, 1985; pp. 609-613, Deptartment of Metallurgy, Norway.
Patent Abstracts of Japan for Japanese Publication 60-027450; http://www19.ipdl.inpit.go.jp/PA1/result/detail/main/wAAAWpaqE2DA360027450...; Feb. 12, 1985, 1 page.
Patent Abstracts of Japan for Japanese Publication 61-276751; http://www19.ipdl.inpit.go.jp/PA1/result/detail/main/wAAWpaqE2DA361276751...; Dec. 6, 1986; 1 page.
Patent Abstracts of Japan for Japanese Publication 62-006742; http://www19.ipdl.inpit.go.jp/PA1/result/main/wAAAWpaqE2DA3620067422...; Jan. 13, 1987; 1 page.
Patent Abstracts of Japan for Japanese Publication 64-004458; http://www19.ipdl.inpit.go.jp/PA1/result/detail/main/wAAAWpaqE2DA364004458...; Jan. 9, 1989; 1 page.
Patent Abstracts of Japan for Japanese Publication 01-202344; http://www19.ipdl.inpit.go.jp/PA1/result/detail/main/wAAACGaqhoDA401202344P1.htm; Aug. 15, 1989; 6 pages.
Patent Abstracts of Japan for Japanese Publication 01-242762; http://www19.ipdl.inpit.go.jp/PA1/result/detail/main/wAAAo_aq3fDA401242762P1.htm; Sep. 27, 1989; 1 page.
J. Masounave et al.; The Design and Implementation of the IMRI Strip Caster; 1988; pp. 473-492; The Metallurgial Society.
Manabu Nakai et al.; Influence of Additional Elements on the Resistance to Stress Corrosion Cracking of Al-Mg Alloys; 1991; pp. 419-424; The Japan Institute of Light Metals; Japan.
Wojtek Szczypiorski et al.; The Mechanical and Metallurgical Characteristics of Twin-Belt Cast Aluminum Strip Using Current Hazelett Technology; The Minerals, Metals & Materials Society; 1991; pp. 805-814.
Joseph R. Davis et al.; vol. 4 Heat Treating; ASM Handbook; Aug. 1991; pp. 851-857 and 878-879; ASM International; USA.
L. Amberg et al.; Aluminum Alloys-Their Physical and Mechanical Properties; Jun. 1992; pp. 20-27; vol. 1; The Norwegian Institute of Technology; Norway.
Aluminum Standards and Data 1993; Table 3.5-Typical Annealing Treatments for Aluminum Alloy Mill Products; 1993; 2 pages; The Aluminum Association Incorportated.
Patent Abstracts of Japan for Japanese Publication 05-277656; http://www19.ipdl.inpit.go.jp/PA1/result/detail/main/wAAAWpaqE2DA405277656...; Oct. 26, 1993; 1 page.
Patent Abstracts of Japan for Japanese Publication 06-071303; http://www19.ipdl.inpit.go.jp/PA1/result/detail/main/wAAAySa4DBDA406071303P1...; Mar. 15, 1994; 1 page.

Pan Fusheng et al.; The SIC Distribution in the As-Cast Strips of SICP/A356 Aluminum Matrix Composites by the Twin Roll Casting; Acta Materials Composite Sinica; Feb. 1995; 9 pages; vol. 12, No. 1; Chongqing University; China.
Patent Abstracts of Japan for Japanese Publication 07-148557; http://www19.ipdl.inpit.go.jp/PA1/result/detail/main/wAAAWpaqE2DA407148557...; Jun. 13, 1995; 1 page.
P.A. Karnezis et al.; Mechanical Properties and Microstructure of Twin Roll Cast Al-7Si/SiCp MMCs; Materials Science and Technology; Aug. 1995; pp. 741-751; vol. 11; University of Pittsburgh, PA.
Yoshihiro Nakayama et al.; Precipitation Behaviors of B-Phase and Changes in Mechanical Properties of AL-MG System Alloys; 1996; pp. 1269-1274; Transtec Publications Ltd.; Switzerland.
P.A. Karnezis et al.; Effect of Processing on the Microstructure and Tensile Properties of A356/SiCp MMCs; Materials Science Form vols. 217-222; 1996; pp. 341-346 Transtec Publications; Switzerland.
SU 1453932 A1, Abstract of Invention for Application No. 4193818/02; Mar. 27, 1996; 1 page.
P.A. Karnezis et al.; Characterization of Reinforcement Distribution in Cast Al-Alloy/SiCp Composites; Materials Characterizations; Apr. 1997; pp. 97-109; Elsevier Science Inc.; USA.
Leitarou Yamaguchi et al.; Effect of Zn Addition on Intergranular Corrosion Resistance of Al-Mg-Si-Cu Alloys; Aluminum Alloys, Their Pysical and Mechanical Properties; 1998; pp. 1657-1662; vol. 3; The Japan Institute of Light Metals; Japan.
Toshio Haga et al.; High Speed Roll Caster for Aluminum Alloy Strip; Aluminum Alloys; vol. 1; pp. 327-332; Osaka Institute of Technology; Japan.
T. Sheppard; 4.12 Press Quenching and Press Solutionizing, Extrusion of Aluminum Alloys; 1999; pp. 186-191; Kluwer Academic Publishers; The Netherlands.
Toshio Haga et al.; High-Speed Roll Caster for Strip Casting of Aluminm Alloy; Meterials Science Forum; vols. 331-337; 2000; pp. 185-190; Trans Tech Publications; Switzerland.
E.S. Puchi-Cabrera; Modeling Cold-Rolling Process of Commercial Twin Roll Cast Aluminum Alloys; Sep. 14, 2000; 1 page; Universidad Central de Venezuela; Venzuela.
D. Tomes et al.; Properties of O, T4 adn T6 Temper Products Manufactured In-Line at Alcoa Micromill; Dec. 12, 2002; 11 pages; Alcoa Inc.
U.S. Patent and Trademark Office; Office Action Issued Against U.S. Appl. No. 10/078,638; Mar. 18, 2003; 4 pages; USA.
D. Tomes et al.; Properties of 6061 Sheet, Heat Treatable In-Line at Alcoa Micromill; Jun. 2, 2003; 8 pages; Alcoa Inc.
D.A. Tomes et al.; Properties of Alloy AX-07 in O-Temper Annealed in Line at Alcoa Micromill; Jul. 15, 2003; 23 pages; Alcoa Inc.
D.A. Tomes et al.; Properties of Heat Treatable 6022 Sheet Made In-Line at Alcoa Micromill; Sep. 18, 2003; 26 pages; Alcoa Inc.
Patent Cooperation Treaty; PCT International Search Report Issued in Connection with International Application No. PCT/US03/18764; Sep. 29, 2003; Europe.
Ali Unal et al.; Properties of Al-10%Mg Alloy Sheet Made from Alcoa Micromill Strip; Jan. 22, 2004; 45 pages; Alcoa Inc.
U.S. Patent and Trademark Office; Office Action Issued Against U.S. Appl. No. 10/461,704; Jun. 18, 2004; 4 pages USA.
Patent Cooperation Treaty; PCT Written Opinion Issued in Connection with International Application No. PCT/US03/18764; Jul. 1, 2004; 4 pages; Europe.
U.S. Patent and Trademark Office; Office Action Issued Against U.S. Appl. No. 10/782,027; Sep. 17, 2004; 11 pages; USA.
Patent Cooperation Treaty; PCT International Preliminary Examination Report Issued in Connection with PCT/US03/18764; Oct. 5, 2004; 3 pages; Europe.
U.S. Patent and Trademark Office; Office Action Issued Againt U.S. Appl. No. 10/461,704; Oct. 28, 2004; 7 pages; USA.
Hirosuke Inagaki; Precipitation of the B -Phase in Al-Mg Alloys; 2005; pp. 45-53; Shonan Institute of Technology; Japan.
Ali Unal; Declaration Under 37 C.F.R. 1.132, Filed in Connection with U.S. Appl. No. 10/461,704; Jan. 20, 2005; 12 pages.
Gaute Svenningson et al.; Effect of Artificial Aging on Intergranualr Corrosion of Extruded AlMgSi Alloy with Small Cu Content; Jan. 25, 2005; pp. 1528-1543; Elsevier Ltd.; Norway.
U.S. Patent and Trademark Office; Notice of Non-Compliant Amendment Issued in Connection with U.S. Appl. No. 10/782,027; Feb. 4, 2005; 2 pages; USA.
Ali Unal et al.; Microstructure of Al-6Sn Alloy Strip Cast in Alcoa Micromill; May 13, 2005; 31 pages; Alcoa Inc.
U.S. Patent and Trademark Office; Notice of Non-Compliant Amendment Issued in Connection with U.S. Appl. No. 10/782,027; Jun. 2, 2005; 13 pages; USA.
U.S. Patent and Tradmark Office; Advisory Action Before the Filing of an Appeal Brief Issued Againt U.S. Appl. No. 10/782,027; Sep. 29, 2005; 8 pages; USA.
Patent Cooperation Treaty; PCT International Perliminary Report on Patentability Issued in Connection with International Application No. PCT/US05/04558; Jan. 18, 2006; 6 pages; Europe.
U.S. Patent and Trademark Office; Office Action Issued Against U.S. Appl. No. 10/782,027; Feb. 21, 2006, 12 pages; USA.
RU 2284364 C2; Abstract of Invention for Russian Application No. 2004116858/02; Feb. 27, 2006; 1 page.
European Patent Office; European Office Action Issued Against European Patent Application No. 02706344.5; Sep. 19, 2006; 4 pages; Europe.
Patent Abstracts for Japanese Application No. 63-023717; http://www19.ipdl.ncipi.go.jp/PA1/result/detail/main/wAAACGaqhoDA401202344P1.htm; 2 pages; Website Printed Oct. 3, 2006.
European Patent Office; European Office Action Issued Against European Patent Application No. 02706344.5; May 3, 2007; 3 pages; Europe.
Patent Cooperation Treaty; PCT International Search Report Issued in Connection with International Application No. PCT/US05/28353; Aug. 27, 2007; 2 pages; Europe.
Patent Cooperation Treaty; PCT Written Opinion of the International Searching Authority Issued in Connection with International Application No. PCT/US05/28353; Aug. 27, 2007; 6 pages; Europe.
Japan Patent Office; Notification of Reason for Refusal Issued Against Japanese Application No. 2002-565730; Nov. 20, 2007; 4 pages; Japan.
European Patent Office; European Office Action Issued Against European Application No. 02706344.5; Dec. 14, 2007; 2 pages; Europe.
The Patent Office of the People's Repulic of China; Notification of First Office Action Issued Against Chinese Application No. 2005800109516; Jan. 4, 2008; 5 pages; China.
XP-002486412; C:/EPOPROGS\SEA\.\.\.\epodata\sea\eplogf\sa799343. log; Jan. 7, 2008; 1 page.
XP-002486413; C:/EPOPROGS\SEA\.\.\.\epodata\sea\eplogf\sa799343. log; Jan. 7, 2008; 1 page.
XP-002486414; C:/EPOPROGS\SEA\.\.\.\epodata\sea\eplogf\sa799343. log; Jan. 7, 2008; 1 page.
XP-002486415; C:/EPOPROGS\SEA\.\.\.\epoclata\sea\eplogf\sa799343. log; Jan. 7, 2008; 1 page.
Korean Intellectual Property Office; Office Action Issued Against Korean Application No. 2003-7010929; Jan. 14, 2008; 6 pages; Korea (South).
European Patent Office; Supplementary European Search Report Issued in Connection with European Application No. 05713469; Jan. 17, 2008; 2 pages; Europe.
Russian Federation Patent Office; Office Action Issued Against Russian Application No. 2006133381/02; Apr. 1, 2008; 5 pages; Russia.
European Patent Office; European Office Action Issued Against European Application No. 02706344.5; Apr. 2, 2008; 4 pages; Europe.
The Patent Office of the People's Republic of China; Notification of Second Office Action Issued Against Chinese Application No. 2005800109516; Jun. 20, 208; 4 pages; China.
Patent Cooperation Treaty; PCT International Search Report Issued in Connection with International Application No. PCT/US2008/060060; Jul. 18, 2008; 5 pages; Europe.
Patent Cooperation Treaty; PCT Written Opinion of the International Searching Authority Issued in Connection with International Application No. PCT/US2008/060060; Jul. 18, 2008; 9 pages; Europe.
U.S. Patent and Trademark Office; Office Action Issued Against U.S. Appl. No. 11/549,408; Jul. 24, 2008; 7 pages; USA.

Canadian Intellectual Property Office; Office Action Issued Against Canadian Application No. 2,557,417; Aug. 14, 2008; 4 pages; Canada.
Japan Patent Office; Notice of Reasons for Refusal Issued Against Japanese Application No. 2006-554150; Oct. 28, 2008; 8 pages; Japan.
Japan Patent Office; Notice of Reasons for Refusal Issued Against Japanese Application No. 2004-530797; Dec. 2, 2008; 4 pages; Japan.
Korean Intellectual Property Office; Notice of Grounds for Refusal Issued Against Korean Application No. 10-2006-7017913; Dec. 13, 2008; 4 pages; Korea (South).
Korean Intellectual Property Office; Notice of Final Rejection Issued Against Korean Application No. 10-2006-7017913; Jan. 29, 2009; 3 pages; Korea (South).
Australian Government, IP Australia; Examiner's First Report Issued Against Australian Application No. 2005214348; Apr. 1, 2009; 2 pages; Australia.
U.S. Patent and Trademark Office; Office Action Issued Against U.S. Appl. No. 11/734,121; Apr. 28, 2009; 7 pages; USA.
Korean Intellectual Property Office; Notice of Result of Reexamination Issued in Connection with Korean Application No. 10-2006-7017913; Jun. 24, 2009; 4 pages; Korea (South).
Metals Knowledge: Problems and Prospect of Al-Mg Alloys Application in Marine Constructions; Oct. 20, 2009; 5 pages.
Intellectual Property Tribunal of Korea; Transmittal Certified Copy Decision on Trial Issued in Connection with Korean Application No. 2006-7017913; Nov. 4, 2009; 10 pages; Korea (South).
Patent Cooperation Treaty; PCT International Search Report Issued in Connection with International Application No. PCT/US2009/059820, Jan. 21, 2010; 5 pages; Europe.
Patent Cooperation Treaty; PCT Written Opinion of the International Searching Authority Issued in Connection with International Application No. PCT/US2009/059820; Jan. 21, 2010; 9 pages; Europe.
Patent Cooperation Treaty; PCT International Search Report Issued in Connection with International Application No. PCT/US2009/060887; Feb. 26, 2010; 4 pages; Europe.
Patent Cooperation Treaty; PCT Written Opinion of the International Searching Authority Issued in Connection with International Application No. PCT/US2009/060887; Feb. 26, 2010; 7 pages; Europe.
Russian Federation; Russian Office Action Issued in Connection with Russian Application No. 2009141598/02; Mar. 28, 2010; 10 pages; Russia.
Korean Intellectual Property Office; Notice of Grounds for Refusal Issued Against Korean Application No. 10-2005-7002906; Apr. 23, 2010; 6 pages; Korea (South).
U.S. Patent and Trademark Office; Office Action Issued Against U.S. Appl. No. 12/246,937; Apr. 23, 2010; 6 pages; USA.
U.S. Patent and Trademark Office; Office Action Issued Against U.S. Appl. No. 12/267,303; Apr. 26, 2010; 7 pages; USA.
State Intellectual Property of the People's Republic of China; Notification of the Third Office Action Issued Against Chinese Application No. 200580010951.6; May 19, 2010; 4 pages.; China.
U.S. Patent and Trademark Office; Office Action Issued Against U.S. Appl. No. 12/246,937; May 20, 2010; 5 pages; USA.
U.S. Patent and Trademark Office; Office Action Issued Against U.S. Appl. No. 12/267,303; Jun. 4, 2010; 6 pages; USA.
European Patent Office; European Office Action Issued Against European Application No. 08799790.4; Jun. 29, 2010; 5 pages; Europe.
Intergranual Corrosion and SCC Properties of Al-Mg-Si Alloy Sheets; http://sciencelinks.jp/j-east/article/200311/000020031103A0295070.php; Printed Sep. 2, 2010; 1 page.
U.S. Patent and Trademark Office; Office Action Issued Against U.S. Appl. No. 12/246,937; Sep. 24, 2010; 6 pages; USA.
State Intellectual Property Office of the People's Republic of China; Office Action Issued Against Chinese Application for Utility Model No. 200920291302.3; Sep. 29, 2010; 3 pages; China.
Korean Intellectual Property Office; Korean Notification of Final Rejection Issued Against Korean Application No. 10-205-7002906; Oct. 27, 2010; 3 pages; Korea (South).
U.S. Patent and Trademark Office; Final Office Action Issued Against U.S. Appl. No. 12/267,303; Jan. 12, 2011; 8 pages; USA.
Russian Federation; Russian Office Action Issued in Connection with Russian Application No. 2009141589/02; Jan. 12, 2011; 6 page; Russia.
Korean Intellectual Property Office; Notification of Grounds for Refusal Issued Against Korean Application No. 10-2009-7011352; Jan. 16, 2011; 8 pages; Korea (South).
European Patent Office; European Office Action Issued in Connection with European Application No. 08799790.4; Feb. 4, 2011; 5 pages; Europe.
Ali Unal; Declarations Under 37 C.F.R. § 1.132 of Ali Unal, Filed in Connection with U.S. Appl. No. 12/246,937; Feb. 4, 2011; 7 pages.
Ali Unal; Declaration of Ali Unal Filed in Connection with Korean Application No. 10-2005-7002906; Feb. 21, 2011; 6 pages.
Patent Cooperation Treaty; PCT International Perliminary Report on Patentability Issued in Connection with International Applicaiton No. PCT/US2009/059820; Apr. 12, 2011; 9 pages; Europe.
U.S. Patent and Trademark Office; Office Action Issued Agsint U.S. Appl. No. 12/246,937; Apr. 29, 2011; 7 pages; USA.
Korean Intellectual Property Office; Notification of Grounds for Refusal Issued Against Korean Application No. 10-2011-7004617; May 11, 2011; 3 pages; Korea (South).
State Intellectual Property Office of the People's Republic of China; Notification of the First Office Action Issued Against Chinese Application No. 200880018281.6; May 25, 2011; 4 pages; China.
U.S. Patent and Trademark Office; Office Action Issued Against U.S. Appl. No. 12/913,999; Jul. 29, 2011; 11 pages; USA.
U.S. Patent and Trademark Office; Office Action Issued Against U.S. Appl. No. 12/913,972; Aug. 10, 2011; 10 pages; USA.
Russian Federation Patent Office; Formal Official Action Issued Against Russian Application No. 2011122789/20; Aug. 30, 2011; 4 pages; Russia.
U.S. Patent and Trademark Office; Office Action Issued Against U.S. Appl. No. 12/267,303; Aug. 31, 2011; 9 pages; USA.
Korean Intellectual Property Office; Notification of Grounds for Refusal Issued Against Korean Application No. 10-2005-7002906; Oct. 18, 2011; 5 pages; Korea (South).
State Intellectual Property Office of the People's Republic of China; Notification of the First Office Action, Issued Against Chinese Application No. 200880018209.3; Dec. 2, 2011; 9 pages; China.
Cast Aluminum Alloys Designation System; Aluminum Alloy and Temper Designation Systems of the Aluminum Associateion; pp. 11 and 16-19.

* cited by examiner

STRIP CASTING OF IMMISCIBLE METALS

FIELD OF THE INVENTION

This invention relates to the casting of metals and to a method of strip casting immiscible metals in particular.

BACKGROUND OF THE INVENTION

Aluminum based alloys containing Sn, Pb and Cd are commonly used in bearings found in internal combustion engines. The bearing function in these alloys is performed by the soft second phase particle of the alloying element which melts in the event of lubricant failure and prevents contact between the aluminum in the alloy and the steel protected by the bearing.

In the prior art, the soft second phase in these alloys separates during solidification and often appears in the form of non uniform distribution. In many cases the second phase forms at grain boundaries as a continuous layer, or the heavier component (Sn, Pb, Cd) settles to the bottom due to gravity segregation. Typically, heat treatment is required after cold rolling of the cast sheet to redistribute the soft phase. For Al—Sn alloys for example, this is done by an annealing treatment at 662° F. (350° C.) during which the soft phase melts and coagulates into a desired uniform distribution of unconnected particles. In a final processing step, the strip is bonded on a steel backing for use as bearings in engines.

Twin roll casting of Aluminum based bearing alloys yields better distribution of the second phase particles compared to conventional ingot casting. A drawback of twin roll casting, however, is that the method is slow, yields low productivity and creates a distribution of the soft phase(s) that is not completely desirable. Suitable results are also produced using a powder metallurgy process; however this method is expensive. There is a need, therefore, for a method that results in higher productivity and yields a uniform distribution of fine particles of the soft phase in the aluminum matrix.

SUMMARY OF THE INVENTION

The present invention discloses a method of strip casting an aluminum alloy from immiscible liquids that yields a highly uniform structure of fine second phase particles. The results of the present invention are achieved by using a known casting process to cast the alloy into a thin strip at high speeds. In the method of the present invention, the casting speed is preferably in the region of about 50-300 feet per minute (fpm) and the thickness of the strip preferably in the range of 0.08-0.25 inches. Under these conditions, favorable results are achieved when droplets of the immiscible liquid phase nucleate in the liquid ahead of the solidification front established in the casting process. The droplets of the immiscible phase are engulfed by the rapidly moving freeze front into the space between the Secondary Dendrite Arms (SDA).

As the SDA are small under rapid solidification conditions, (in the range of 2-10 μm) the droplets of the immiscible phase are uniformly distributed in the cast strip and are very fine.

DETAILED DESCRIPTION OF PREFERRED EMBODIMENTS

Figure 1:
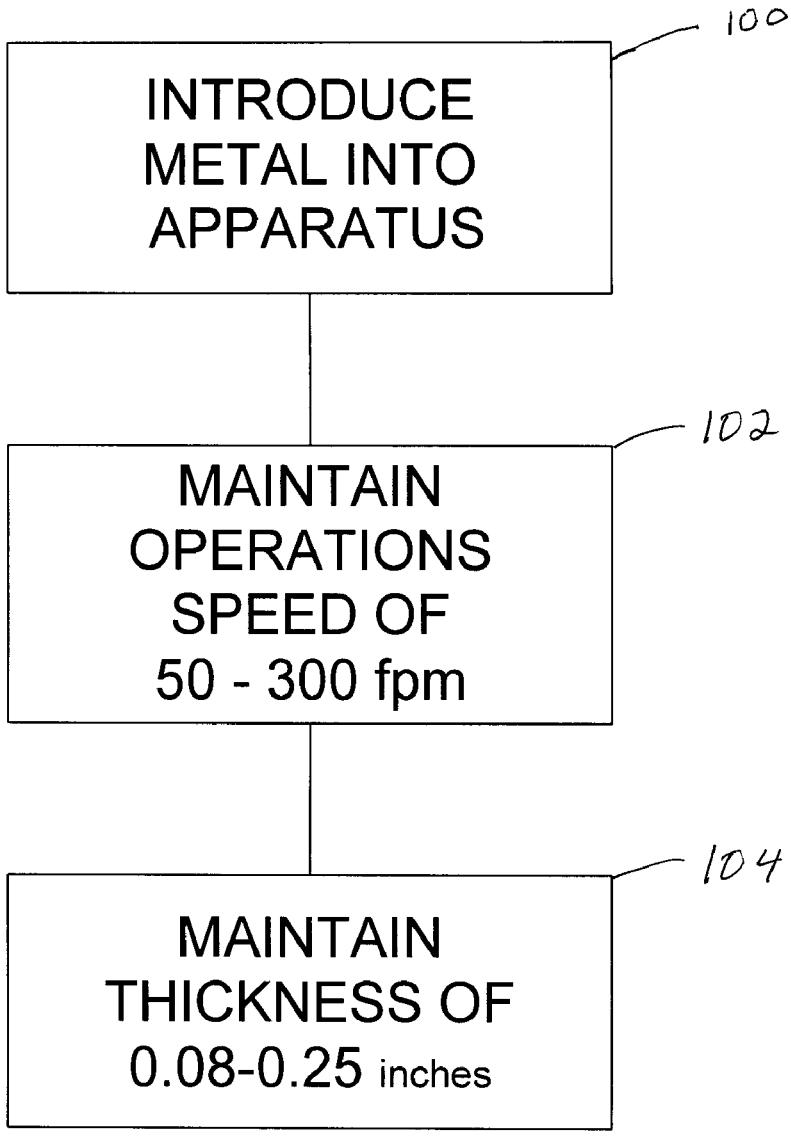
FIG. 1 is a flow-chart describing the method of the present invention.

The accompanying drawings and the description which follows set forth this invention in its preferred embodiments. It is contemplated, however, that persons generally familiar with casting processes will be able to apply the novel characteristics of the structures and methods illustrated and described herein in other contexts by modification of certain details. Accordingly, the drawings and description are not to be taken as restrictive on the scope of this invention, but are to be understood as broad and general teachings. When referring to any numerical range of values, such ranges are understood to include each and every number and/or fraction between the stated range minimum and maximum.

Finally, for purposes of the description hereinafter, the terms "upper", "lower", "right", "left", "vertical", "horizontal", "top", "bottom", and derivatives thereof shall relate to the invention, as it is oriented in the drawing figures.

The phrases "aluminum alloys", are intended to mean alloys containing at least 50% by weight of the stated element and at least one modifier element. Suitable aluminum alloys include alloys of the Aluminum Association.

The method of the present invention is depicted schematically in the flow chart of FIG. 1. As depicted therein, in step 100 a molten metal comprising aluminum and at least one immiscible phase is introduced into a suitable casting apparatus. In step 102, the casting apparatus is operated at a casting speed greater than 50-300 fpm. In step 104, the thickness of the cast strip is maintained at 0.08-0.25 inch or smaller.

The method of the present invention is suitable for use with known casting methods such as those disclosed in U.S. Pat. Nos. 5,515,908 and 6,672,368 for example. These methods produce thin strips at high speeds resulting in productivity in the range 600 to 2000 lb/hr per inch of width cast.

Figure 2:
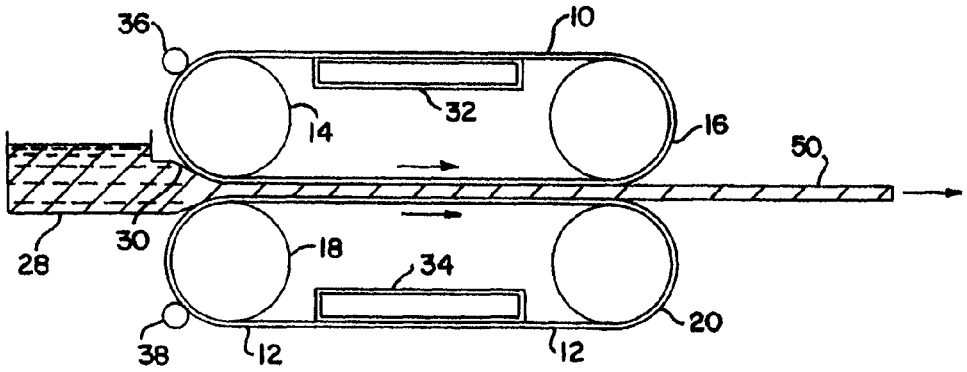
FIG. 2 is a schematic depicting an example of an apparatus that can perform the method of the present invention.
Figure 3:
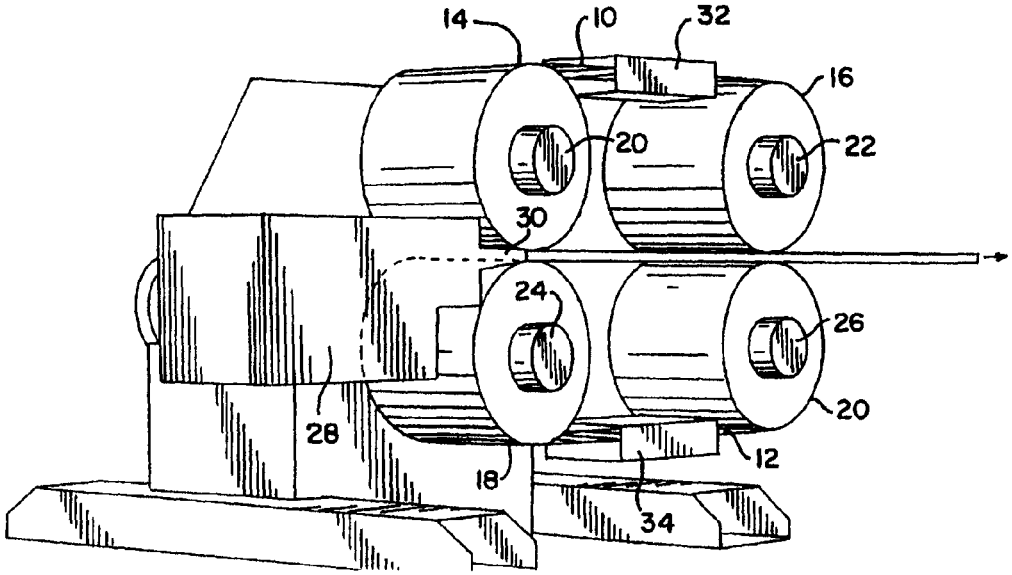
FIG. 3 is a perspective view detailing apparatus that can be operated in accordance with the present invention.
Figure 4:
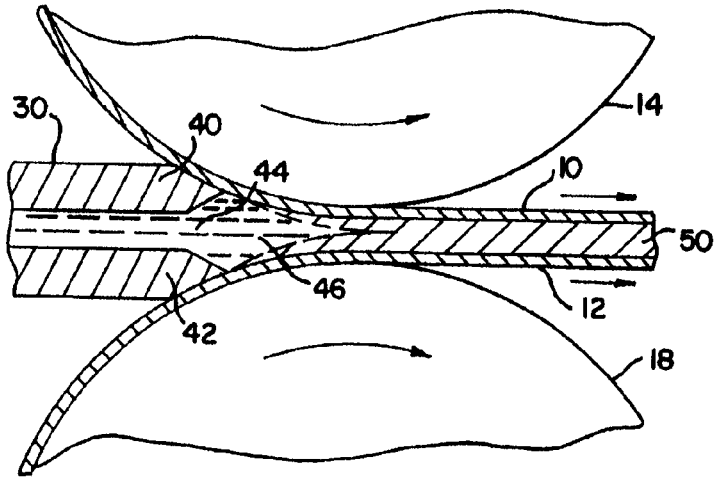
FIG. 4 is a cross-sectional view of the entry of molten metal to the apparatus illustrated in FIGS. 2 and 3.

An example of apparatus that can be employed in the practice of the present invention is illustrated in FIGS. 2, 3 and 4 of the drawings. The apparatus depicted therein is in accordance with that disclosed in Commonly owned U.S. Pat. No. 5,515,908 and is presented as only one example of apparatus that can be used to achieve the results of the method of the present invention.

The process will now be illustrated with respect to the apparatus depicted in FIG. 2, but is also applicable to the equipment depicted in FIGS. 3 and 4. As is depicted in FIG. 2, the apparatus includes a pair of endless belts 10 and 12 that act as casting molds carried by a pair of upper pulleys 14 and 16 and a pair of corresponding lower pulleys 18 and 20. Each pulley is mounted for rotation about an axis 21, 22, 24, and 26 respectively of FIG. 2. The pulleys are of a suitable heat resistant type, and either or both of the upper pulleys 14 and 16 is driven by a suitable motor means (not shown). The same is true for the lower pulleys 18 and 20. Each of the belts 10 and 12 is an endless belt, and is preferably formed of a metal which has low reactivity or is non-reactive with the metal being cast. Quite a number of suitable metal alloys may be employed as well known by those skilled in the art. Good results have been achieved using steel and copper alloy belts. Other metallic belts can also be used such as aluminum. It should be noted that in this embodiment of the invention casting molds are implemented as casting belts 10 and 12.

However casting molds can comprise a single mold, one or more rolls or a set of blocks for example.

The pulleys are positioned, as illustrated in FIGS. 2 and 3, one above the other with a molding gap therebetween. The gap is dimensioned to correspond to the desired thickness of the metal strip being cast. Thus, the thickness of the metal strip being cast is determined by the dimensions of the nip between belts 10 and 12 passing over pulleys 14 and 18 along a line passing through the axis of pulleys 14 and 18 which is perpendicular to the casting belts 10 and 12. Molten metal to be cast is supplied to the molding zone through metal supply means 28 such as a tundish. The interior of tundish 28 corresponds in width to the width of the product to be cast, and can have a width up to the width of the narrower of the casting belts 10 and 12. The tundish 28 includes a metal supply delivery casting tip 30 to deliver a horizontal stream of molten metal to the molding zone between the belts 10 and 12.

Thus, the tip 30, as shown in FIG. 4, defines, along with the belts 10 and 12 immediately adjacent to tip 30, a molding zone into which the horizontal stream of molten metal flows. Thus, the stream of molten metal flowing substantially horizontally from the tip fills the molding zone between the curvature of each belt 10 and 12 to the nip of the pulleys 14 and 18. It begins to solidify and is substantially solidified by the point at which the cast strip reaches the nip of pulleys 14 and 18. Supplying the horizontally flowing stream of molten metal to the molding zone where it is in contact with a curved section of the belts 10 and 12 passing about pulleys 14 and 18 serves to limit distortion and thereby maintain better thermal contact between the molten metal and each of the belts as well as improving the quality of the top and bottom surfaces of the cast strip.

The casting apparatus shown in FIGS. 2, 3 and 4 includes a pair of cooling means 32 and 34 positioned opposite that portion of the endless belt in contact with the metal being cast in the molding gap between belts 10 and 12. The cooling means 32 and 34 thus serve to cool the belts 10 and 12 just after they pass over pulleys 16 and 20, respectively, and before they come into contact with the molten metal. As illustrated in FIGS. 2 and 3, the coolers 32 and 34 are positioned as shown on the return run of belts 10 and 12, respectively. The cooling means 32 and 34 can be conventional cooling means such as fluid cooling tips positioned to spray a cooling fluid directly on the inside and/or outside of belts 10 and 12 to cool the belts through their thicknesses.

Thus molten metal flows horizontally from the tundish through the casting tip 30 into the casting or molding zone defined between the belts 10 and 12 where the belts 10 and 12 are heated by heat transfer from the cast strip to the belts 10 and 12. The cast metal strip remains between and is conveyed by the casting belts 10 and 12 until each of them is turned past the centerline of pulleys 16 and 20. Thereafter, in the return loop, the cooling means 32 and 34 cool the belts 10 and 12, respectively, and remove therefrom substantially all of the heat transferred to the belts in the molding zone. The supply of molten metal from the tundish through the casting tip 30 is shown in greater detail in FIG. 4 of the drawings. As is shown in that figure, the casting tip 30 is formed of an upper wall 40 and a lower wall 42 defining a central opening 44 therebetween whose width may extend substantially over the width of the belts 10 and 12.

The distal ends of the walls 40 and 42 of the casting tip 30 are in substantial proximity to the surface of the casting belts 10 and 12, respectively, and define with the belts 10 and 12 a casting cavity or molding zone 46 into which the molten metal flows through the central opening 44. As the molten metal in the casting cavity 46 flows between the belts 10 and 12, it transfers its heat to the belts 10 and 12, simultaneously cooling the molten metal to form a solid strip 50 maintained between casting belts 10 and 12. Sufficient setback (defined as the distance between first contact 47 of the molten metal 46 and the nip 48 defined as the closet approach of the entry pulleys 14 and 18) is provided to allow substantially complete solidification prior to the nip 48.

To produce the results yielded by the method of the present invention utilizing the apparatus described in FIGS. 2-4, a molten aluminum based alloy comprising a phase that is immiscible in the liquid state is introduced via tundish 28 of FIG. 3 through casting tip 30 into the casting zone defined between belts 10 and 12. Preferably, the dimensions of the nip between belts 10 and 12 passing over pulleys 14 and 18 should be in the range of 0.08 to 0.25 inches, and the casting speed is 50-300 fpm. Under these conditions, droplets of the immiscible liquid phase nucleate ahead of the solidification front and are engulfed by the rapidly moving freeze front into the space between the SDA spaces. Thus, the resulting cast strip contains a uniform distribution of the droplets of the immiscible phase.

Figure 5:
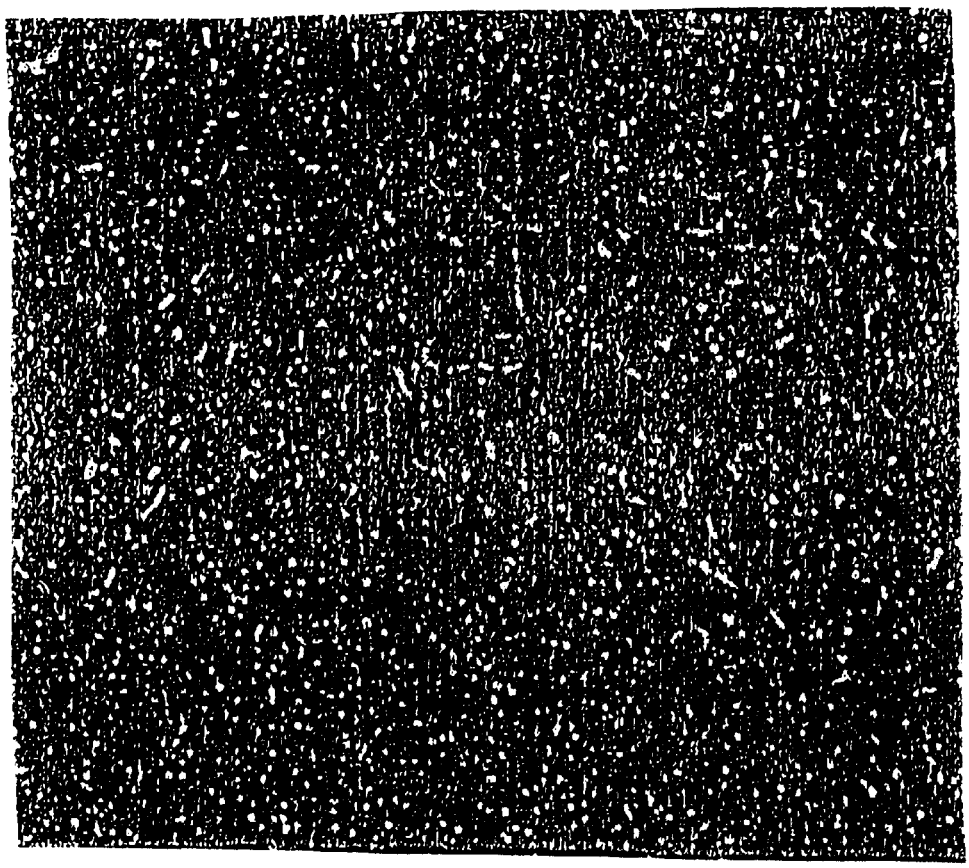
FIG. 5 is a photomicrograph of a transverse section of a strip produced in accordance with the present invention.

Turning now to FIG. 5 a photomicrograph of a section of a Al-6Sn strip 400 produced in accordance with the present invention is shown. The strip shows a highly uniform distribution of fine Sn particles 401 which are 3 μm or smaller. This result is several times smaller than particles that would result from material made from an ingot or by roll casting which are typically 40-400 μm in size. Moreover, the strip produced by the present invention requires no heat treatment for re-distribution of the soft phase and is ideal for providing the required lubricating properties for use in bearings for example. If so desired the strip can be used in as-cast form without being subject to additional fabrication such as rolling for example.

Having described the presently preferred embodiments, it is to be understood that the invention may be otherwise embodied within the scope of the appended claims.

What is claimed is:

1. A method of casting metals comprising:

providing a molten aluminum alloy to a casting apparatus, the molten aluminum alloy comprising at least about 0.1 weight percent alloying addition, wherein the alloying addition is substantially immiscible with molten aluminum, the casting apparatus having a first casting surface, a second casting surface, and a nip formed between the first and second casting surface, the nip having a thickness ranging from 0.08 inches to 0.25 inches;

advancing the aluminum alloy at a speed ranging from between 50 feet per minute and about 300 feet per minute, wherein a point of complete solidification of the aluminum alloy is formed at the nip, wherein the aluminum alloy is advanced through the nip, by rotation of the first casting surface and by rotation of the second casting surface, wherein fine droplets of the immiscible alloying addition nucleate ahead of a solidification front created in the aluminum alloy thereby depositing the fine droplets between secondary dendrite arms of the aluminum alloy, wherein the fine droplets are less than three microns in size, and wherein the fine droplets of the immiscible alloying addition are uniformly distributed throughout the alloy.

2. The method according to claim 1 wherein the alloying addition comprises at least one of Sn, Pb, Bi and Cd.

3. The method according to claim 1 wherein the alloying addition comprises at least 0.1 weight % Sn.

4. The method according to claim 1 wherein the alloying addition comprises at least 0.1 weight % Pb.

5. The method according to claim 1 wherein the alloying addition comprises at least 0.1 weight % Bi.

6. The method according to claim 1 wherein the alloying addition comprises at least 0.1 weight % Cd.

7. A method of casting metals comprising:

providing a molten aluminum alloy to a casting apparatus, the molten aluminum alloy comprising about 6 weight percent tin, the casting apparatus having a first casting surface, a second casting surface, and a nip formed between the first and second casting surface, the nip having a thickness ranging from 0.08 inches to 0.25 inches; and forming a point of complete solidification of the aluminum alloy at the nip, wherein fine droplets of the tin nucleate ahead of a solidification front created in the aluminum alloy thereby depositing the fine droplets of tin between secondary dendrite arms of the aluminum alloy, wherein the fine droplets of tin are less than three microns in size, and wherein the fine droplets of the tin addition are uniformly distributed throughout the alloy.

8. The method of casting metals of claim 7, further comprising advancing the aluminum alloy at a speed ranging from between 50 feet per minute and about 300 feet per minute.

9. The method of casting metals of claim 8, wherein the aluminum alloy is advanced through the nip by rotation of the first casting surface and by rotation of the second casting surface.

* * * * *